United States Patent [19]

Brisson

[11] 4,172,481

[45] Oct. 30, 1979

[54] FLAIL DEVICE

[75] Inventor: Maurice J. Brisson, Laval, Canada

[73] Assignee: Forano Limitee, Plessisville, Canada

[21] Appl. No.: 904,806

[22] Filed: May 11, 1978

[30] Foreign Application Priority Data

Feb. 16, 1978 [CA] Canada ..... 297047

[51] Int. Cl.[2] ..... B27L 1/00

[52] U.S. Cl. ..... 144/208 J; 56/294; 144/2 Z; 172/45; 241/191; 241/193

[58] Field of Search ..... 407/3 S, 43; 172/45; 144/2 N, 2 Z, 208 R, 208 J; 56/294, 12.7; 241/189 R, 191, 193, 194

[56] References Cited

U.S. PATENT DOCUMENTS

| | | | |
|---|---|---|---|
| 1,147,351 | 7/1915 | Williams | 241/193 |
| 1,552,498 | 9/1925 | Noyes | 144/208 J |
| 1,758,647 | 5/1930 | Burrell et al. | 144/208 J |
| 1,762,595 | 6/1930 | Smith | 144/208 J |
| 2,531,732 | 11/1950 | Hoffman | 144/194 |
| 2,901,011 | 8/1959 | Eaton | 144/208 J |
| 3,017,912 | 1/1962 | Sybertz et al. | 144/42 X |
| 3,139,918 | 7/1964 | Gröberg | 56/294 X |
| 3,219,076 | 11/1965 | Logan et al. | 144/42 |
| 3,237,276 | 1/1966 | Von Der Ohe | 144/230 X |
| 3,779,319 | 12/1973 | Pease | 172/45 |

FOREIGN PATENT DOCUMENTS

| | | | |
|---|---|---|---|
| 1336076 | 6/1963 | France | 144/208 J |
| 83369 | 3/1954 | Norway | 144/208 J |
| 117459 | 10/1946 | Sweden | 144/208 J |

*Primary Examiner*—Robert Louis Spruill
*Assistant Examiner*—W. D. Bray
*Attorney, Agent, or Firm*—Cushman, Darby & Cushman

[57] ABSTRACT

The flail device comprises a rotatable drum, a series of circumferentially spaced channels extending lengthwise of the drum, support means in each channels, a rod received in each support means, and flexible flails attached to each support means at longitudinally spaced intervals thereon; each flail consists of a length of chain links and the rod in each support means passes through the end link of the flails which are extendible under centrifugal force when the drum is rotating.

7 Claims, 8 Drawing Figures

FLAIL DEVICE

FIELD OF THE INVENTION

The present invention relates to a flail device and, more particularly, to a rotating device equipped with flails which, under centrifugal force, extend to break or condition objects, such as detaching branches, leaves or bark from trees or conditioning ski slopes, etc.

BACKGROUND OF THE INVENTION

Flail devices are used for delimbing trees such as described in Canadian Pat. No. 598,362 issued May 17, 1960 to Horncastle or in Canadian Pat. No. 964,965 issued Mar. 25, 1975 to Stadnick. Similar flail devices may be used for removing the bark from felled timber such as described in U.S. Pat. No. 2,893,451 issued July 7, 1959 Dickerson or in U.S. Pat. No. 2,891,317 issued Apr. 22, 1958 to Watkins. In another domain, such flail devices may be used for breaking up and conditioning hard snow on ski slopes, such as described in U.S. Pat. No. 3,779,319 issued Dec. 18, 1973 to Pease.

Methods of connecting flails to the rotatable drum consist, in some of above listed patents, in fixedly securing, i.e. by welding, one end of each flail to the drum outer surface or to a member which, in turn, is fixedly attached to the drum surface, and, in some of the other patents, in providing the drum surface with a series of holes through which extend the end link of each chain; a rod is then passed through the loop of each end link for securing the flails to the drum.

In the first-mentioned types of prior flail devices, worn or damaged chains can only be replaced by breaking up the rigid connection existing between the chain and the drum while, in the latter types of flail devices, an end plate on the drum must be removed and the connecting rod pull out of each loop and then out of the drum; the damaged chain is replaced by a new one and the rod is again passed through the end loop of each chain. Hence, the replacement of damaged chains on present flail devices is time consuming and non-economical since the drum is not in use during flail removal.

OBJECTS AND STATEMENT OF THE INVENTION

It is an object of this invention to provide a flail device wherein damaged or worn chains can be quickly and simply replaced so that downtime is considerably shortened when compared with that of prior flail devices. This is achieved by providing in a drum a flail support means which can immediately be replaced by a new flail support means, thus allowing the drum to function while the damaged flails can be repaired or replaced from the removed flail support means.

The present invention therefore relates to a flail device which comprises: a rotatable drum; a plurality of circumferentially spaced channels extending lengthwise of the drum; flail support means engagedly received in each channel; flexible flails attached to each support means at longitudinally spaced intervals thereon; each flail consisting of a length of chain links; one end link being secured to the support means; the flails being extendible under centrifugal force when the drum is rotating.

Other objects and further scope of applicability of the present invention will become apparent from the detailed description given hereinafter; it should be understood, however, that the detailed description, while indicating preferred embodiments of the invention, is given by way of illustration only since various changes and modifications within the spirit and scope of the invention will become apparent to those skilled in the art.

DESCRIPTION OF PREFERRED EMBODIMENTS

Figures 1, 2:
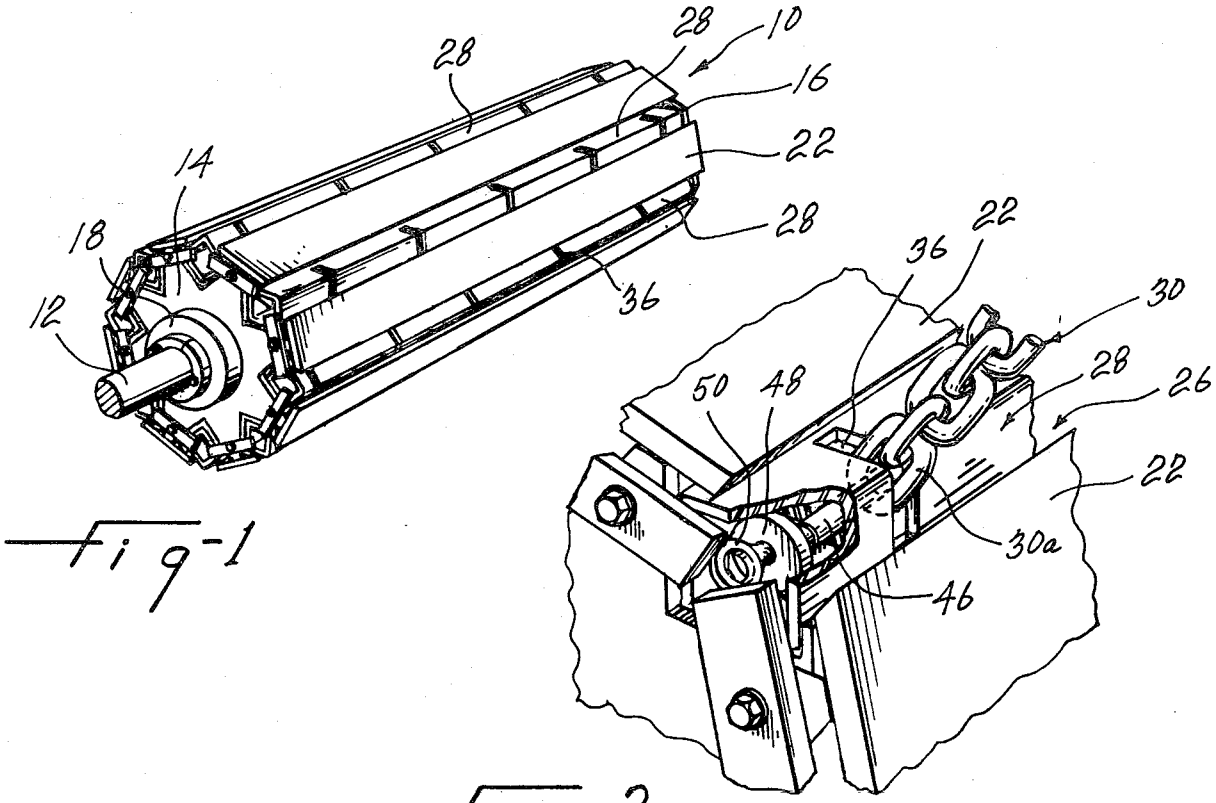
FIG. 1 is a perspective view of the drum, without the flails, made in accordance with the present invention.
FIG. 2 is an enlarged perspective view of one end portion of the flail device.

Referring to FIG. 1 of the drawings, the flail device of the present invention includes a drum 10 mounted for rotation on a shaft 12. The drum has two opposite end plates 14 and 16 fixedly mounted to shaft 12 by means of bushing arrangements 18 and 20 (see FIG. 4). The drum has a general cylindrical configuration but is formed of a series of longitudinal plates 22 which are secured, such as by welding, to the pointed extremities of a series of internal separator plates 24 which have a star-shaped configuration. End plate 14 also has a star-shaped configuration and together with plates 22 define a series of circumferentially-spaced channels 26 extending lengthwise of the drum. Each channel 26 is closed at one end by end plate 16 and while its opposite end is opened and in registry with the openings extending between the pointed ends of the star-shaped end plate 14.

Figure 3:
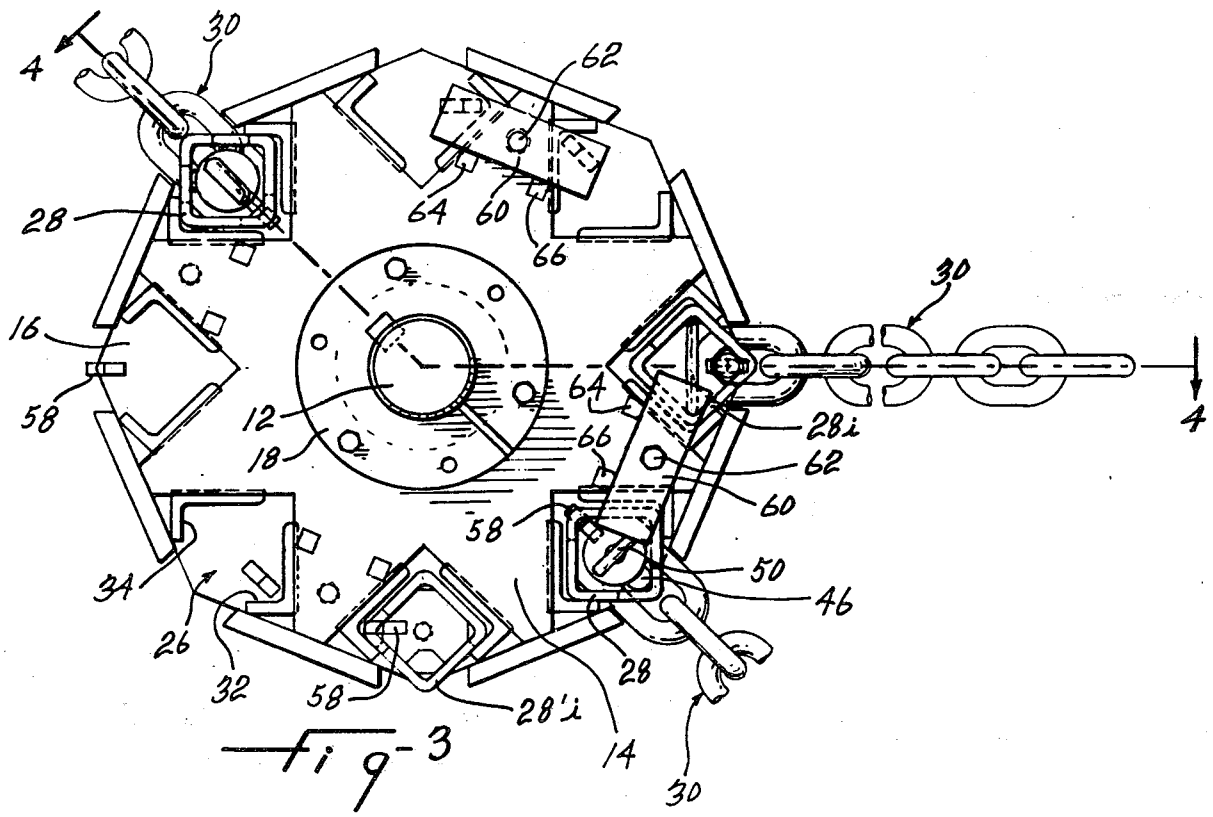
FIG. 3 is an end view of the flail device.

Referring to FIG. 2, a flail support means is provided in each channel 26; it consists of a hollow tube 28 having a cross-section corresponding substantially to the cross-section of the channels from which extends a series of flexible flails 30. As can be seen in FIG. 3, each channel 26 includes two oppositely spaced L-shaped corner gussets 32 and 34 fixed to plates 24 and serving as support plates for the hollow tube 28.

Figure 5:
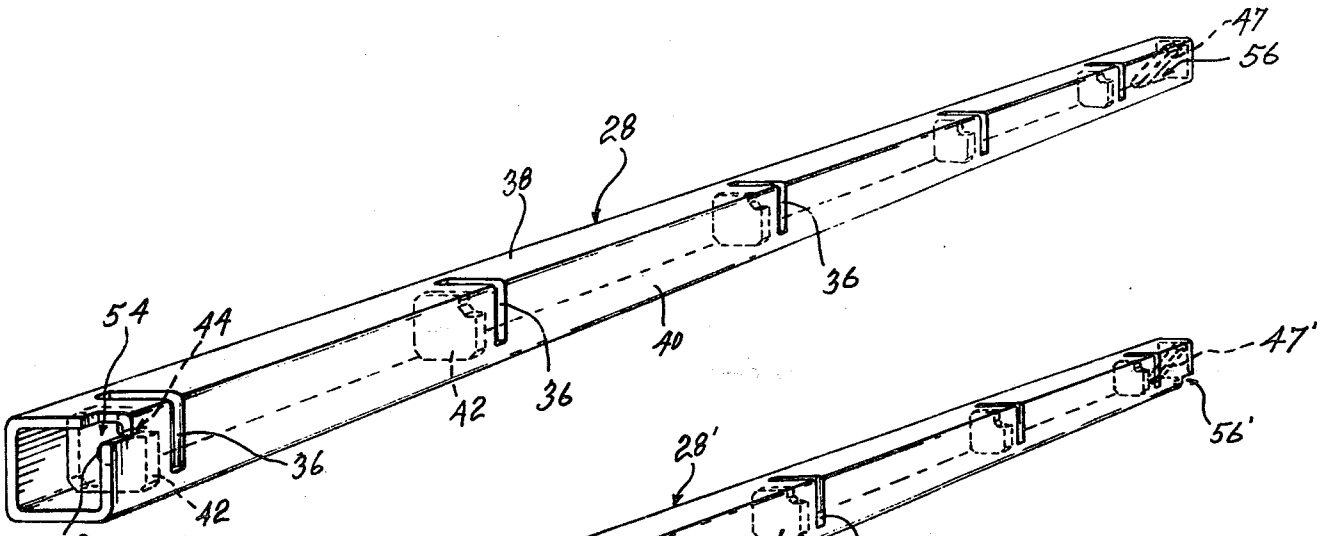
FIGS. 5 and 6 are perspective views of two flail support means used with the flail device of FIG. 3.

Referring to FIG. 5 an illustration of one hollow tube 28 is given. The tube includes a series of longitudinally spaced L-shaped transverse slots 36 extending on two side walls 38 and 40 thereof. The size of the slots is such as to allow sideway insertion of a chain link **30*a*. Inside the tube, a series of longitudinally spaced rod-supporting members 42 are fixed, for example by spot welding. Each member 42 has a notch 44 at one corner thereof to receive a rod 46** as hereinafter described.

Figure 4:
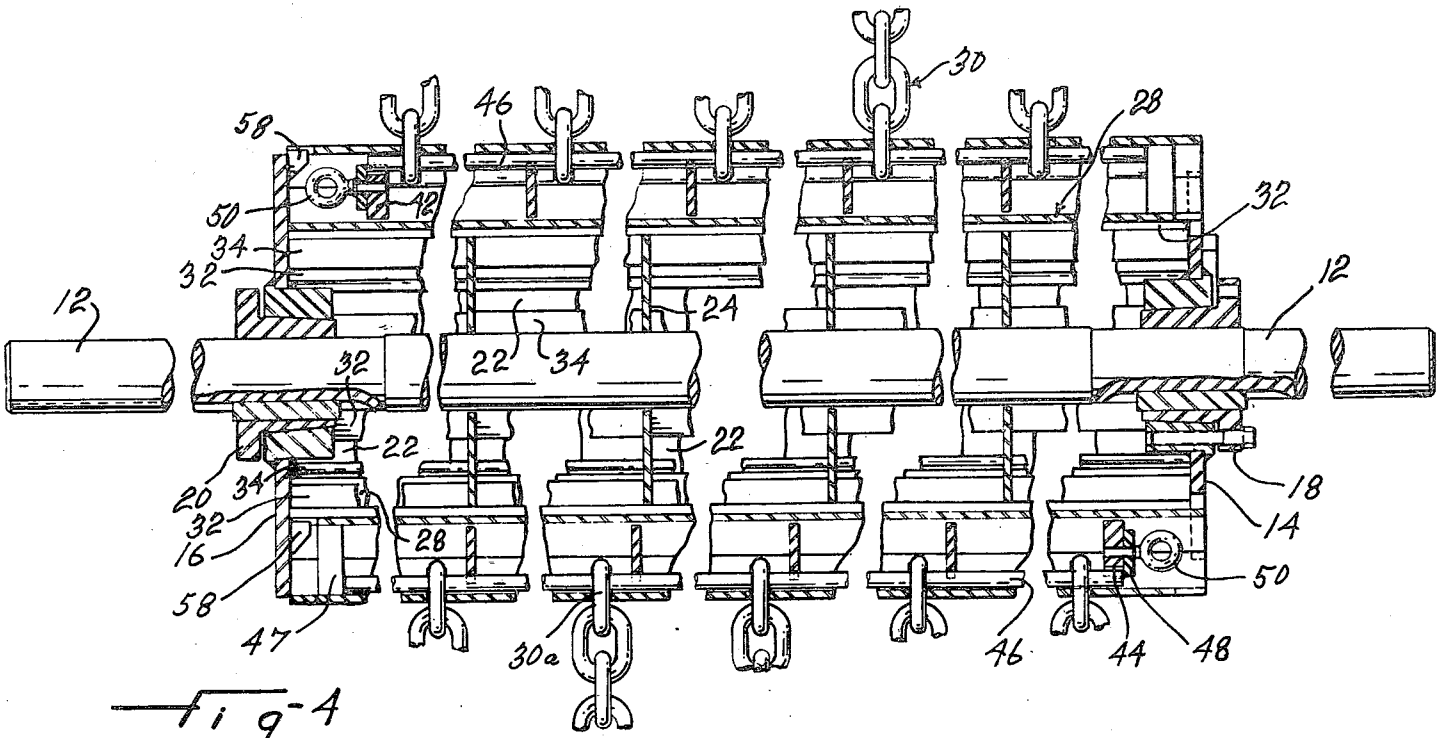
FIG. 4 is a longitudinal cross-sectional view taken along lines 4—4 of FIG. 3.

As illustrated in FIG. 4, rod 46 finds support on notches 44 and is contained inside tube 28 between end wall 47 of the tube and a ring 48 having a diameter sufficiently large to extend beyond noch 44 to abut the end of rob 46. Ring 48 is held against member 42 by means of a locking pin 50 which threadedly engages an opening 52 provided centrally in plate 42. Rod 46 extends through the end link **30*a*** of each chain.

Figure 6:
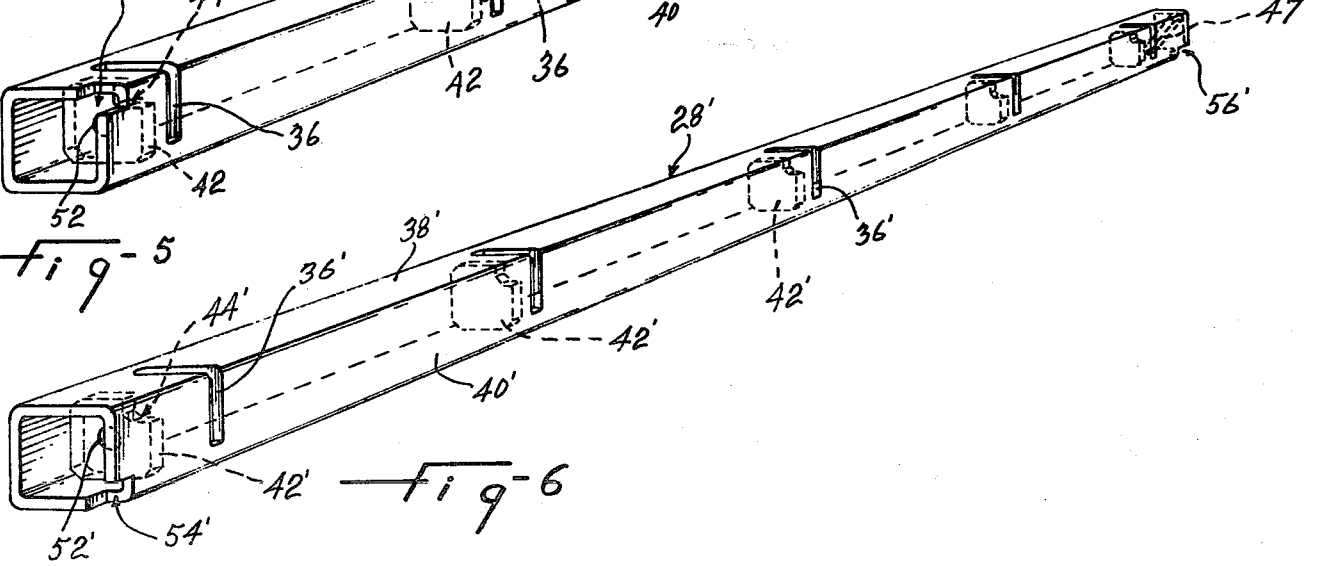
Figure 8:
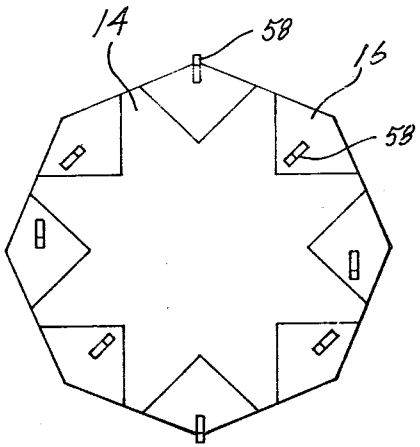
FIGS. 7 and 8 are schematic representations of the arrangement of the flail support means on the drum.
Figure 7:
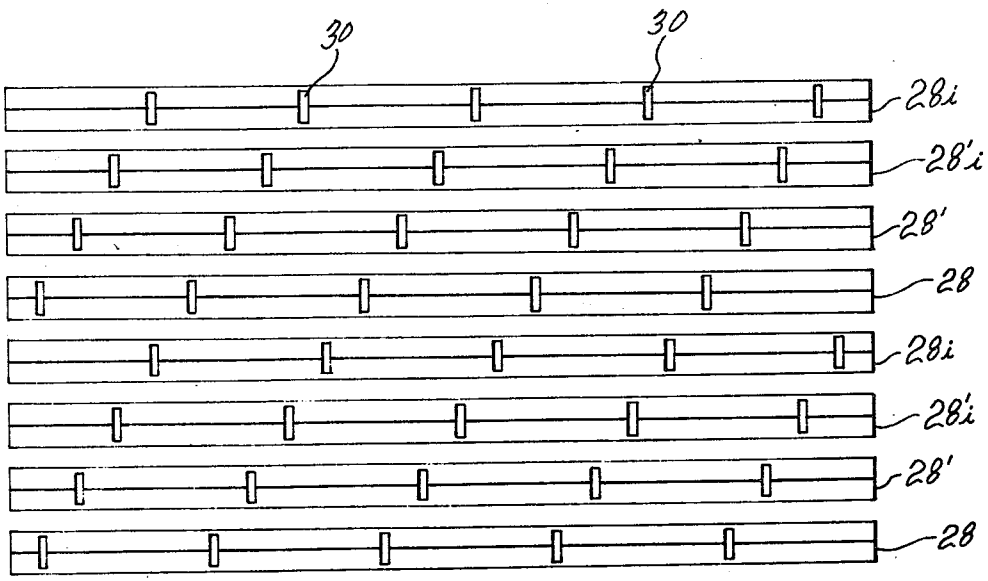

The tube 28 has, at its opposite end, notches 54 and 56 which cooperate with bosses 58 provided on the inner wall of the end plate 16. To obtain the desired staggered arrangement of flails illustrated in FIG. 7, first, a second tube 28′ must be provided (see FIG. 6) and, secondly, tubes 28 and 28′ must be alternatively inverted. Tube 28′ has a construction somewhat similar to tube 28 except for a different location of notches 54′ and 56′ at opposite ends of the tube and for slots 36′ which are at a different distance from the ends of tube when compared to the distance of slots 36 on tube 28. In FIG. 7, arrangements A2 and B2 correspond to tubes 28′ and 28, respectively, while tube arrangements A1 and B1 correspond to tubes 28*i* and 28′*i* (the lower script i indicating that tubes 28 and 28′ are inverted) as the lower and upper tubes shown in FIG. 4. FIG. 8 shows the various location of bosses 58 on the end plate 16 to achieve the flail arrangement of FIG. 7.

Tubes 28 are maintained in channels 26 by brackets 60 which are fastened, for example, by means of bolts 62, to alternate pointed ends of the star-shaped end plate 14. Bosses 64 and 66, against which bear the brackets, prevent unduly rotation of the bracket when bolted to the end plate 14.

An important aspect of the present invention is that, in the event of a worn or a broken chain, bracket 60 associated with the tube supporting the broken or worn chain, is unfastened from end plate 14 and the said tube is removed.

Immediately, a new tube having already arranged chains thereon is positioned in the channel. The bracket is fastened and the flail device may once again continue operation while rod removal from the tube and flail substitution are carried out separately.

Although the invention has been described with respect to one form of the invention, it will be evident that it may be modified and refined in various ways. For example, there may be provided in each channel two separate tubes of equal length which could be inserted endwise in each channel from each opposite end of the tube and a centrally disposed wall would be provided on opposite walls of which locating notches would be affixed. In this instance, securing means would be mounted at each end plate for securing the tubes in the channels. In another variant, the tubes could have a shape different from that of the square-shaped tubes 28. It is therefore wished to have it understood that the present invention should not be limited in scope except by the terms of the following claims.

The embodiments of the invention in which an exclusive property or privilege is claimed are defined as follows:

1. A flail device comprising:

a rotatable drum;

a plurality of circumferentially-spaced channels on said drum extending lengthwise thereof;

flail support means extending lengthwise in each of said channels, said flail support means including a rod received lengthwise therein, said flail support means being engagedly received in each said channel;

flexible flails attached to each said support means at longitudinally spaced intervals thereon; each said flail consisting of a length of chain links, one end link thereof being secured to said support means by linking with said rod; said flails being extendible under centrifugal force when said drum is rotating; and securing means for securing said flail support means in said channels; said securing means being releasable for permitting quick replacement of a support means having one or more damaged flails.

2. A flail device as defined in claim 1, wherein said flail support means consist of a hollow member having a series of longitudinally spaced transverse slots and of a rod extending lengthwise in said hollow member adjacent said slots; each slot defining an opening of sufficient size to receive therethrough said end link of said flail; each said rod passing through said end link of said flails associated with a support means.

3. A flail device as defined in claim 2, wherein each said hollow member further includes longitudinally spaced plates fixedly secured in said hollow member for supporting said rod adjacent said slots.

4. A flail device as defined in claim 2, wherein said rotatable drum includes opposite end plates; one of said plates having a star-shaped configuration defining a plurality of peripherally spaced openings in registration with said channels to thereby allow endwise insertion of said hollow members in said channels.

5. A flail device as defined in claim 4, further comprising bracket means secured to said one end plate adjacent said openings for blocking said openings and securing said hollow members in said channels.

6. A flail device as defined in claim 4, wherein each said hollow member has notches at opposite ends thereof and wherein the opposite end plate of said rotatable drum includes indexing bosses cooperating with said notches; the location of said bosses on said opposite end plate and of said notches on said hollow member varying from one channel to an adjacent channel to provide a staggered arrangement of flails on said drum.

7. A flail device comprising: a rotatable drum; a series of circumferentially spaced channels extending lengthwise of said drum; support means extending lengthwise in each of said channels; a rod received in and extending lengthwise in each said support means; and flexible flails attached to each said support means at longitudinally spaced intervals thereon; each said flail consisting of a length of chain links; and said rod in each support means passing through the end link of said flails which are extendible under centrifugal force when said drum is rotating.

* * * * *